United States Patent [19]

Gaiani

[11] 4,443,977

[45] Apr. 24, 1984

[54] MACHINE FOR PRODUCING PARTS HAVING SKEW SURFACES OF PREDETERMINED CONFIGURATION

[75] Inventor: Robert Gaiani, Figeac, France

[73] Assignee: Ratier-Figeac, Figeac, France

[21] Appl. No.: 333,329

[22] Filed: Dec. 22, 1981

[30] Foreign Application Priority Data

Dec. 23, 1980 [FR] France ..... 80 27284

[51] Int. Cl.[3] ..... B24B 21/16

[52] U.S. Cl. ..... 51/146; 51/141; 51/148

[58] Field of Search ..... 51/135 R, 141, 146, 51/148, 170 EB, 328

[56] References Cited

U.S. PATENT DOCUMENTS

| | | | |
|---|---|---|---|
| 1,082,670 | 12/1913 | Wysong | 51/141 |
| 2,618,913 | 11/1952 | Plancon et al. | 51/141 X |
| 2,934,279 | 4/1960 | Nestor et al. | 51/135 R |
| 3,022,611 | 2/1962 | Schaller | 51/141 |
| 3,167,889 | 2/1965 | Jacobi | 51/141 |
| 3,374,583 | 3/1968 | Jacobi | 51/141 |
| 3,408,775 | 11/1968 | Rutt | 51/146 |
| 3,691,698 | 9/1972 | Schaller | 51/135 R X |
| 4,145,846 | 3/1979 | Howland et al. | 51/141 X |

*Primary Examiner*—Frederick R. Schmidt
*Assistant Examiner*—Robert P. Olszewski
*Attorney, Agent, or Firm*—J. David Dainow

[57] ABSTRACT

In order to machine skew surfaces, adjacent cylindrical shaping rollers in adjacent relation are each freely mounted for rotation on roller support frames which are each capable of relative backward or forward longitudinal displacement under the action of a numerical control system. An abrasive belt which is applied against a portion of the periphery of the set of shaping rollers assumes during this portion of travel a configuration corresponding to the instantaneous envelope curve of the transverse cross-sections of the rollers and thus constitutes a tool which provides a variable profile for abrasive machining operations.

3 Claims, 8 Drawing Figures

FIG.1
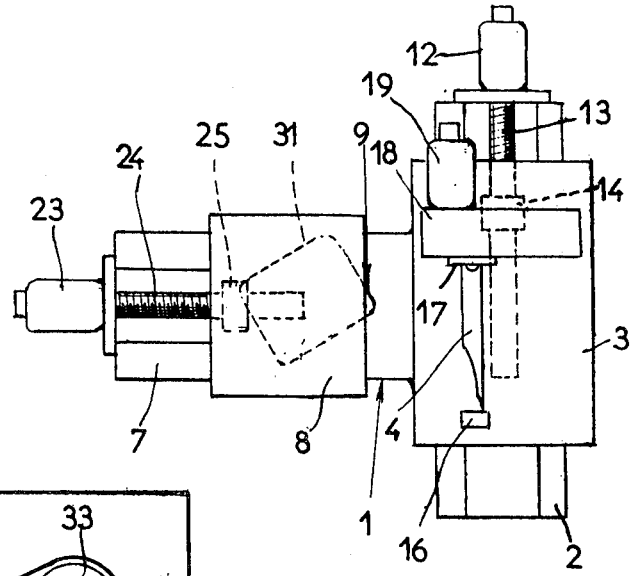
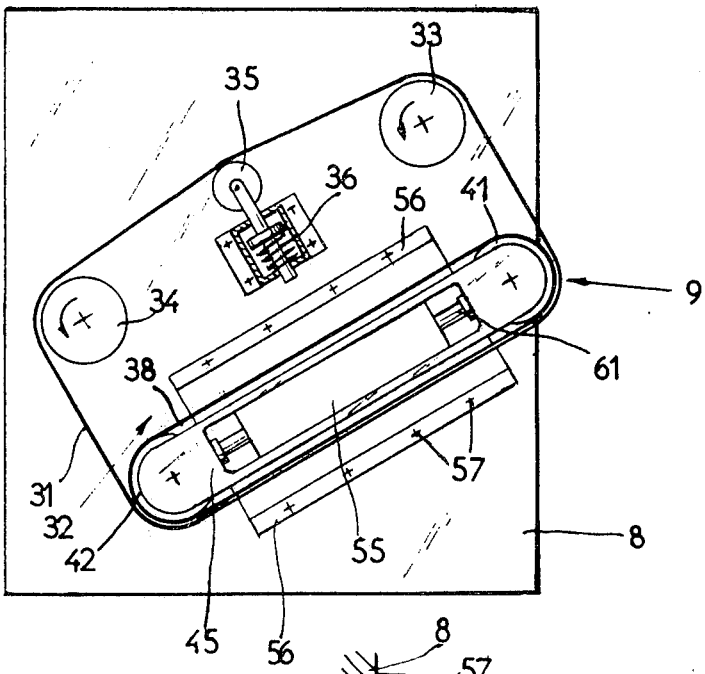
FIG.2
FIG.5
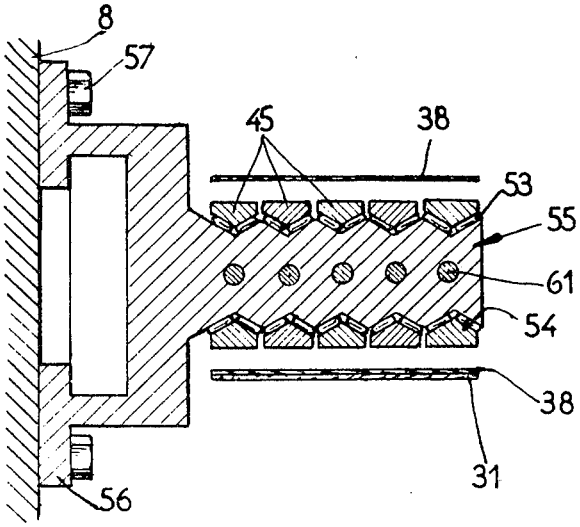

FIG. 7
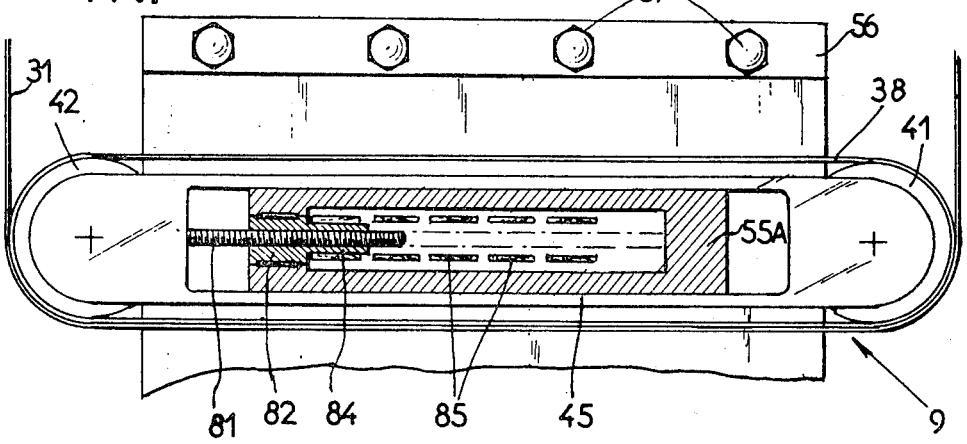
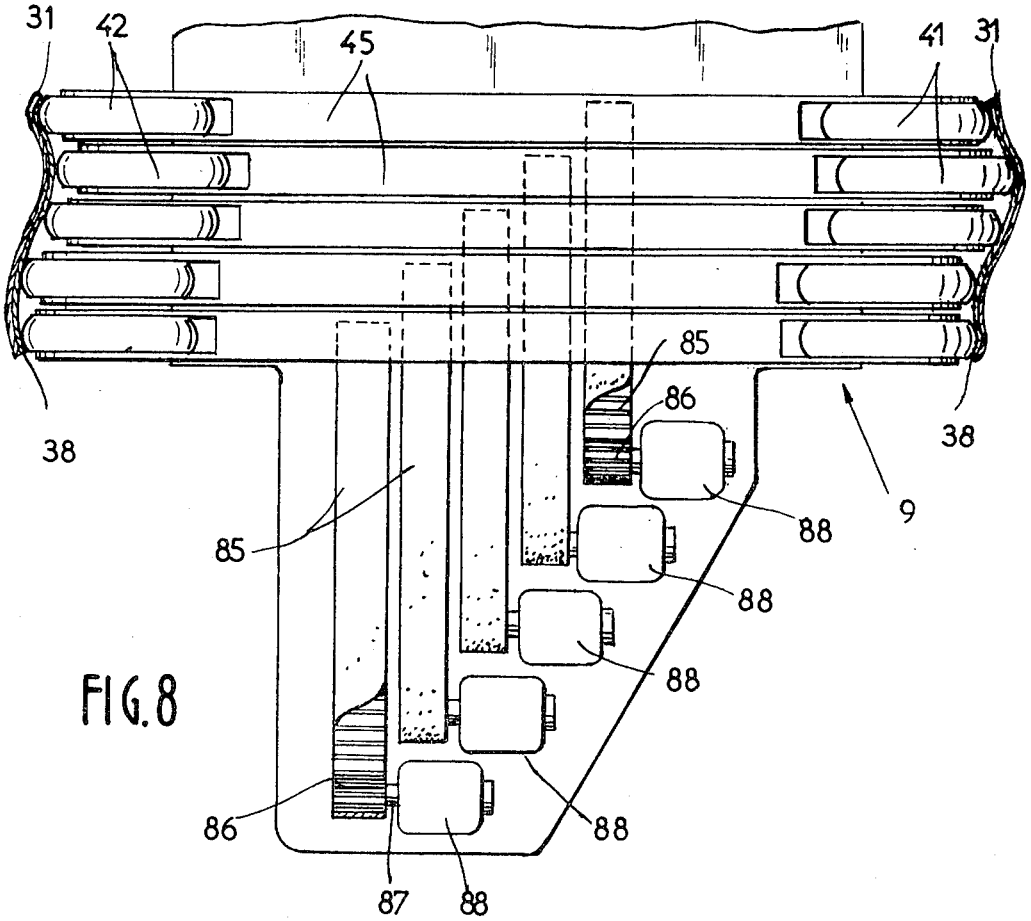
FIG. 8

MACHINE FOR PRODUCING PARTS HAVING SKEW SURFACES OF PREDETERMINED CONFIGURATION

BACKGROUND OF THE INVENTION

This invention relates to a machine for producing parts having skew surfaces of predetermined configuration for such purposes as abrasive machining of aircraft or ship propeller blades, tools for die-stamping of metal sheets in the aeronautical or automobile industry, in the construction of model cars or airplanes and so on.

SUMMARY OF THE INVENTION

The machine according to the invention comprises a set of cylindrical shaping rollers freely mounted for rotation in adjacent relation respectively on support frames, said frames being in turn mounted on a supporting member which is capable of moving with respect to a workpiece support table in such a manner as to permit individual displacement of said roller support frames parallel to a common direction at right angles to the axes of the roller shafts under the action of suitable control means such as, for example, a numerical control system in which said predetermined skew configuration is stored in memory. The machine further comprises means for causing an endless belt to pass over a portion of the periphery of said set of shaping rollers so as to assume during this portion of travel a configuration corresponding to the instantaneous envelope curve of this transverse cross-sections of the rollers and thus to constitute a tool for shaping parts having a variable profile.

In a machine according to the invention, each roller support frame is of elongated shape and provided at each end with a yoke which is adapted to carry a roller. The aforementioned supporting member is adapted to pass through each roller support frame and is common to all the frames which are slidably mounted in said supporting member, the driving means for producing displacements of the roller support frames being interposed between said supporting member and each roller support frame.

Without going into any explanation of structural details, it will immediately be apparent that, if the endless belt is an abrasive belt, a machine of this type makes it possible to machine skew surfaces in materials having very variable characteristics and especially degrees of hardness by removal of material in quantities which may be considerable. The state of surface obtainable by means of this machine is as fine as may be desired and is comparable, for example, with the result achieved by methods involving the use of grinding-wheels since this is an abrasive machining process.

The machine becomes of particular interest if its different moving elements are equipped with servocontrol devices operated in dependence on a programming system in which it is possible to store in memory all the characteristics of a complete cycle for machining a skew surface defined mathematically by cartesian and/or polar coordinates. To this end, it is only necessary to adopt the known principles of machine-tools of the so-called numerical control type.

These and other features of the invention will be more apparent to those skilled in the art upon consideration of the following description. Two embodiments of a machine according to the invention for application to an abrasive machining operation are shown by way of example in the accompanying drawings:

BRIEF DESCRIPTION OF THE DRAWINGS

FIG. 1 is a top plan view of the first embodiment;

FIG. 2 is a bottom plan view of a portion of the machine of FIG. 1 which includes the machining unit on which the invention is based, this view being drawn to a larger scale;

FIG. 5 is a sectional view to a larger scale and taken along line V—V of FIG. 3;

FIG. 7 is a view which is similar to FIG. 3 and illustrates an alternative embodiment;

FIG. 8 is an elevation view corresponding to FIG. 7.

DESCRIPTION OF THE PREFERRED EMBODIMENT

Figure 3:
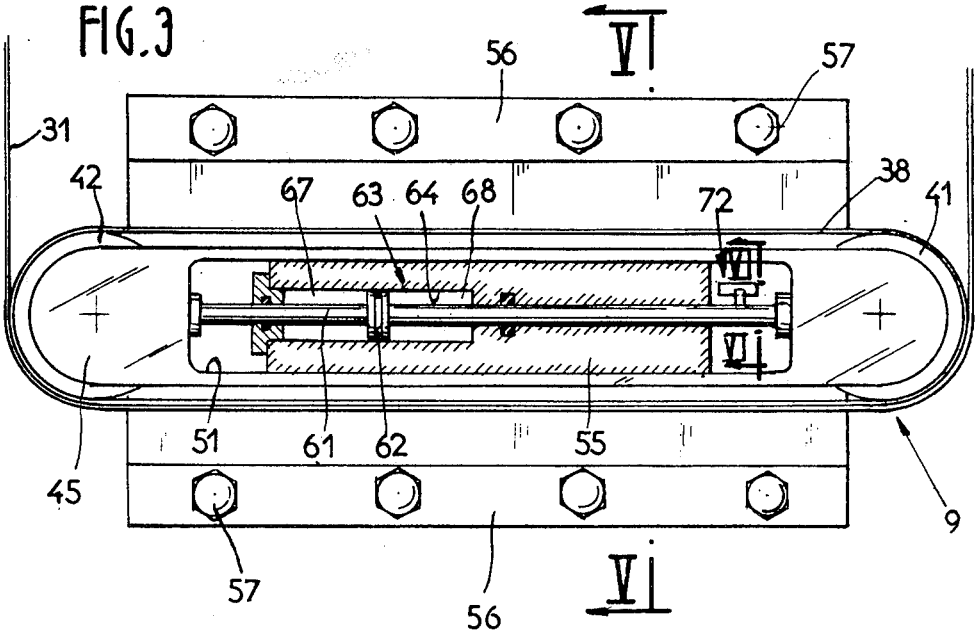
FIG. 3 is a bottom plan view, partially in section in greater detail and drawn to an even larger scale than FIG. 2, showing the main elements of the machining unit.

The machine for abrasive machining as illustrated in a simplified manner in FIG. 1 essentially comprises a frame generally designated by the reference numeral 1 with a bed 2 for supporting a carriage 3 for a workpiece 4 and a bed 7 for supporting a carriage 8 for a machining unit 9. These two beds extend respectively in two horizontal directions at right angles to each other.

The workpiece carriage 3 is slidably displaced on the bed 2 under the action of an electric motor 12 by means of a drive system comprising a ball-circuit screw 13 rotatably mounted in the frame of the bed 2 and a nut 14 which is rigidly fixed to the carriage 3. In the example shown, the workpiece 4 to be machined is of elongated shape such as a propeller blade. One end of said workpiece is supported by a tailstock 16 fixed on the carriage 3 and the other end of said workpiece is placed within the chuck 17 of a dividing chuck-plate 18 which is driven by an electric motor 19.

The machining unit carriage 8 is adapted to slide along the bed 7 under the action of an electric motor 23 by means of a drive system comprising a ball-circuit screw 24 rotatably mounted within the frame of the bed 7 and by means of a nut 25 which is rigidly fixed to the carriage 8.

The machining unit 9 (as also shown in FIG. 2) comprises an endless abrasive belt 31, said belt being adapted to pass over supporting and guiding members which are carried by the carriage 8 and comprise a guiding assembly 32, a driving roller 33 actuated by a motor (not shown), an idler roller 34, and a tensioning roller 35 which is subjected to the action of a spring 36. All these members are covered with a protective plate which masks them in FIG. 1 but which is assumed to have been removed in FIG. 2.

Figure 4:
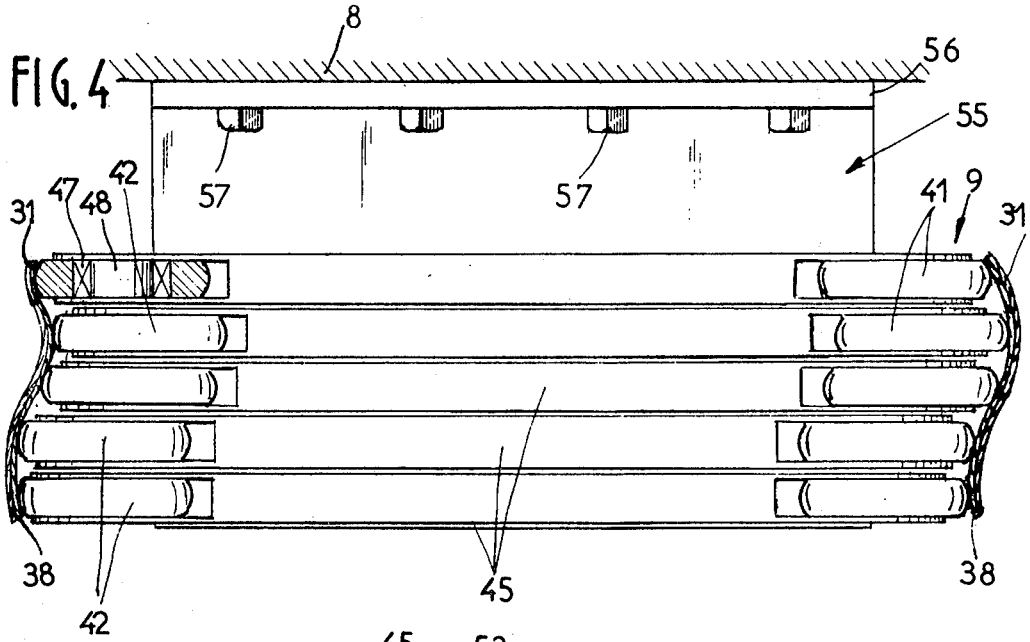
FIG. 4 is a fragmentary plan elevation view corresponding to FIG. 3.

The guiding assembly 32 constitutes the most important part of the machine. This assembly comprises an endless belt 38 (as also shown in FIGS. 3 and 4) against which the abrasive belt 31 is in direct contact and which is in turn supported and guided by two sets of cylindrical rollers, namely: a set of shaping rollers 41 and a set of auxiliary rollers 42. In the example shown, there are five rollers in each of the two sets, but this number could be different according to the applications which may be contemplated. Thus the abrasive belt is not in direct contact with said rollers but is applied against these latter through the intermediary of the tensioned endless belt 38. The rollers are associated in pairs: each pair consists of a shaping roller 41 and of an auxiliary roller 42 which are separately mounted to rotate freely in the two ends respectively of a roller support frame 45 having a generally elongated shape and a flat cross-section. Each roller 41 or 42 is carried by a bearing 47 mounted on a shaft 48 which is fixed between the two arms of a yoke formed on the corresponding end of the roller support frame. In the example shown, there are five roller support frames 45 arranged in adjacent relation as illustrated, each frame having a longitudinal axis extending between the axes of the rollers mounted at each end; said frames being capable of moving in the longitudinal direction and individually with respect to each other the frames are situated with their longitudinal axes aligned or coplaner even though each frame is movable longitudinally. Thus the shaping rollers are located next to each other and can each be relatively displaced either backward or forward in a direction which is parallel to the longitudinal direction of the roller support frame. On each roller frame, the distance between the shaft of the shaping roller and the shaft of the auxiliary roller is permanently established by design and this distance is the same for all the roller frames.

Figure 6:
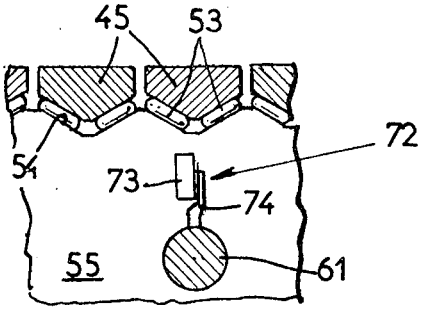
FIG. 6 is a fragmentary part-sectional view, again to a larger scale and taken along line VI—VI of FIG. 3.

The central portion of each roller support frame 45 has a very large internal space 51 by reason of the substantial length of the frame which has two narrow end yokes, the shaping roller and auxiliary roller being rotatably mounted between the arms of said yokes. The long sides of the frame have a cross-section in the shape of an irregular but symmetrical pentagon as shown in FIGS. 4 and 6, with two right dihedral angles adjacent to their outer face, two obtuse dihedral angles and a fifth dihedral angles, the two faces of which are in contact with rollers 53 housed within a slideway 54 having a V-shaped cross-section corresponding to that of the support frame. All the slideways 54 are cut in a common supporting member 55 which extends through the internal spaces 51 of all the roller support frames and is provided with a flange 56 which serves to fix said supporting member on the carriage 8 by means of screws 57 (as shown in FIG. 2).

The endless belt 38 is inextensible in the longitudinal direction but is elastically deformable in the transverse direction. The result thereby achieved is that, when a roller support frame 45 is displaced in the longitudinal direction with respect to the adjacent roller support frames, then it is apparent from the right-hand portion of FIG. 4 that the belt 38 which is in contact with the shaping rollers 41 closely conforms to the envelope surface of the corresponding external surface portions of said rollers, the external surface of each roller being preferably given a rounded shape. The abrasive belt 31 which covers the endless belt 38 therefore has the same configuration. When the frames are positioned with the axes of the shaping rollers coaxial, the belt will have a straight cylinder shape. It will at once be understood that, if the abrasive belt is given any suitable skew configuration by subjecting the roller support frames 45 to suitably programmed relative displacements in synchronism with corresponding programmed displacements of the workpiece to be machined, there is thus provided a variable-profile tool which is capable of machining any mathematically defined skew surface.

Different means may be employed for carrying out programmed displacements of the roller support frames. FIG. 3 illustrates one design in which hydraulic means are adopted. A cylindrical rod 61 constituting the rod of the piston 62 of a hydraulic jack 63 is mounted in the axis of the internal space 51 of each roller support frame 45. The jack cylinder 64 is cut in the common supporting member 55. Depending on whether oil under pressure is passed into the chamber 67 or into the chamber 68 of the jack, the roller support frame is either moved toward the workpiece together with the shaping roller 41 or moved away from said workpiece. The hydraulic control circuits are not illustrated in detail since this technique is well-known.

FIGS. 3 and 6 indicate a linear detector 72 having a rule 73 which is rigidly fixed to the common supporting member 55 and a slider 74 which is rigidly fixed to the piston rod 61 of the jack, thereby ensuring that the "control loop" can be closed.

The machine is equipped with a numerical control installation, the design function of which is to record the characteristics of the skew surface to be machined, to carry out automatic control of the motor 12 for displacing the workpiece carriage 3, of the motor 19 for rotating the workpiece 4, of the motor 23 for displacing the carriage 8 of the machining unit 9, as well as to carry out the control of servo-values for the supply of the hydraulic jacks which serve to carry out the displacements of the roller support frames 45.

FIGS. 7 and 8 illustrate an embodiment in which mechanical means are adopted for carrying out the displacements of the roller support frames 45. In this design, the frames are actuated by means of ball-circuit screws 81, each screw being rigidly fixed to each support frame 45 and engaged in a corresponding internally-threaded sleeve 82 which is freely mounted for rotation without axial displacement within the common stationary supporting member 55A, said member being also suitably hollowed-out for this purpose. The threaded sleeve 82 is provided with an extension 84 in the form of a splined pulley over which is passed a slotted drive-belt 85, said belt being also passed over another splined pulley 86 which is keyed on the shaft 87 of a small electric motor 88 carried by the common stationary supporting member 55. The drive systems consisting of slotted belts 85 associated with the different roller support frames are relatively displaced with respect to each other (as shown in FIG. 8).

The operation of the machine equipped with this system is similar to that of the machine equipped with the hydraulic system described earlier. The numerical control installation controls the electric motors 88 so as to cause these latter to rotate either in one direction or in the other and thus to initiate forward or backward movements of the different roller support frames 45 in the same manner as in the embodiment based on the use of hydraulic jacks.

What is claimed is:

1. In an apparatus for abrading a surface on a workpiece, the apparatus including an endless abrasive belt which has essentially inelastic circumferential length, deformable elastic transverse width and an abrasive outer surface, a base for holding said workpiece and supporting said endless belt, a support movably mounted on said base for maintaining said belt in tension, first drive means for driving said belt circumferentially, and second drive means for moving said support and thereby moving said belt into engagement with said workpiece, the improvement wherein said support comprises: a plurality of frames generally aligned and mounted on said support, each frame having opposite ends, a first set of similar cylindrical shaping rollers, one rotatably mounted on one end of each frame, a second set of similar cylindrical rollers, one rotatably mounted on the opposite end of each frame, the axes of said rollers being parallel, the distance between the axes of the two rollers on each frame being the same, each frame having a longitudinal axis extending between the axes of the two rollers thereon, a first belt circumscribing said two sets of rollers, said first belt having essentially inelastic circumferential length and deformable elastic transverse width, said frames being aligned with their longitudinal axes generally coplanar, each frame being movable in the direction of its longitudinal axis relative to said support and to the other frames, whereby the peripheral edges of the adjacent shaping rollers define (a) a profile curve corresponding to the relative moved position of said frames and (b) a straight cylindrical surface when the axes of these rollers are coincident and the portion of said first belt that engages said first set of rollers being deformed according to said profile curves, said abrasive belt being caused to circumscribe at least the portion of said first belt which engages said first set of rollers, said belts being driven by said first drive means, and said abrasive belt being deformed similarly as said first belt, said second drive means adapted to move said frames selectively to create a selected profile curve in said abrasive belt for engaging said workpiece.

2. Apparatus according to claim 1 wherein said support further comprises a projection part and each of said frames defines an aperture extending therethrough parallel to the axes of said rollers mounted thereon, each of said frames being supported on said projection and movable thereon in the direction of the frame's longitudinal axis.

3. Apparatus according to claim 1 wherein said support further comprises a drive roller rotated by said first drive means and a tension roller, both rotatably mounted on axes transversely spaced from and oriented parallel to the axes of said sets of rollers, said abrasive belt adapted to circumscribe said drive and tension rollers and a portion of said first belt extending between and about said two sets of rollers.

* * * * *